US011780252B2

(12) United States Patent
Bonjoch Roma et al.

(10) Patent No.: US 11,780,252 B2
(45) Date of Patent: Oct. 10, 2023

(54) METHOD AND DEVICE FOR REDUCING DISTORTION WHILE PRINTING ON A FLEXIBLE PRINT MEDIUM

(71) Applicant: Hewlett-Packard Development Company, L.P., Spring, TX (US)

(72) Inventors: Ignasi Bonjoch Roma, Sant Cugat del Valles (ES); Josep Maria Bel Calavia, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 176 days.

(21) Appl. No.: 17/262,010

(22) PCT Filed: Nov. 28, 2018

(86) PCT No.: PCT/US2018/062837

§ 371 (c)(1),
(2) Date: Jan. 21, 2021

(87) PCT Pub. No.: WO2020/112103

PCT Pub. Date: Jun. 4, 2020

(65) Prior Publication Data

US 2021/0309028 A1 Oct. 7, 2021

(51) Int. Cl.

| | |
|---|---|
| ***B41J 15/04*** | (2006.01) |
| ***B65H 23/04*** | (2006.01) |
| ***B65H 37/00*** | (2006.01) |

(52) U.S. Cl.

CPC ..... *B41J 15/048* (2013.01); *B65H 23/048* (2013.01); *B65H 37/002* (2013.01); *B65H 2701/1722* (2013.01); *B65H 2701/1942* (2013.01); *B65H 2801/12* (2013.01)

(58) Field of Classification Search

CPC .... B41J 15/048; B65H 23/048; B65H 37/002; B65H 2701/1722; B65H 2701/1942; B65H 2801/12

See application file for complete search history.

(56) References Cited

U.S. PATENT DOCUMENTS

| | | | |
|---|---|---|---|
| 3,945,870 | A | 3/1976 | Johnsen |
| 4,348,953 | A | 9/1982 | Cole et al. |
| 5,702,789 | A | 12/1997 | Fernandez-Kirchberger et al. |
| 6,779,453 | B2 | 8/2004 | Samii |
| 8,658,266 | B2 | 2/2014 | Lee |
| 2002/0054781 | A1 * | 5/2002 | Korem ..... B41J 3/4078 400/621 |

(Continued)

FOREIGN PATENT DOCUMENTS

| | | | |
|---|---|---|---|
| CN | 1868742 | A | 11/2006 |
| EP | 0779162 | A3 | 7/1998 |

(Continued)

OTHER PUBLICATIONS

Anahi Ouro Blanco, "FESPA Textiles Competitive Analysis" May 2018.

*Primary Examiner* — Henok D Legesse

(57) ABSTRACT

A method to advance a print medium, for example a flexible print medium, through a print zone of a printing device is described. A carrier is fed from a carrier supply. The carrier has an adhesive surface. A print medium is engaged with the adhesive surface of the carrier. The carrier with the engaged print medium is advanced to the print zone.

14 Claims, 12 Drawing Sheets

(56) References Cited

U.S. PATENT DOCUMENTS

| | | | | |
|---|---|---|---|---|
| 2004/0062897 | A1* | 4/2004 | Samii | B41J 3/4078<br>428/40.1 |
| 2014/0106132 | A1 | 4/2014 | Hong et al. | |
| 2018/0050551 | A1 | 2/2018 | Garcia Soto | |

FOREIGN PATENT DOCUMENTS

| | | | |
|---|---|---|---|
| JP | 2001262459 | A | 9/2001 |
| JP | 2002266224 | A | 9/2002 |
| WO | WO-2016136122 | A1 | 9/2016 |

* cited by examiner

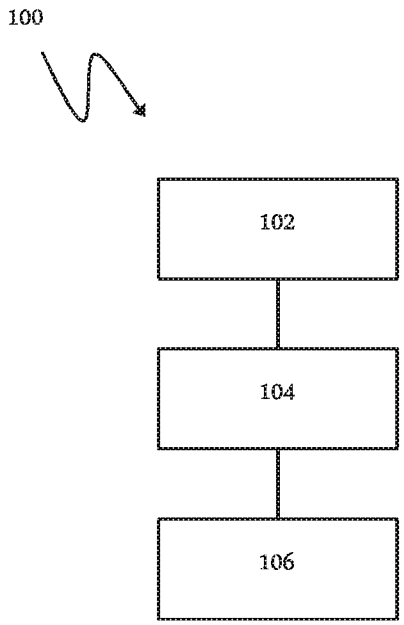
100
102
104
106

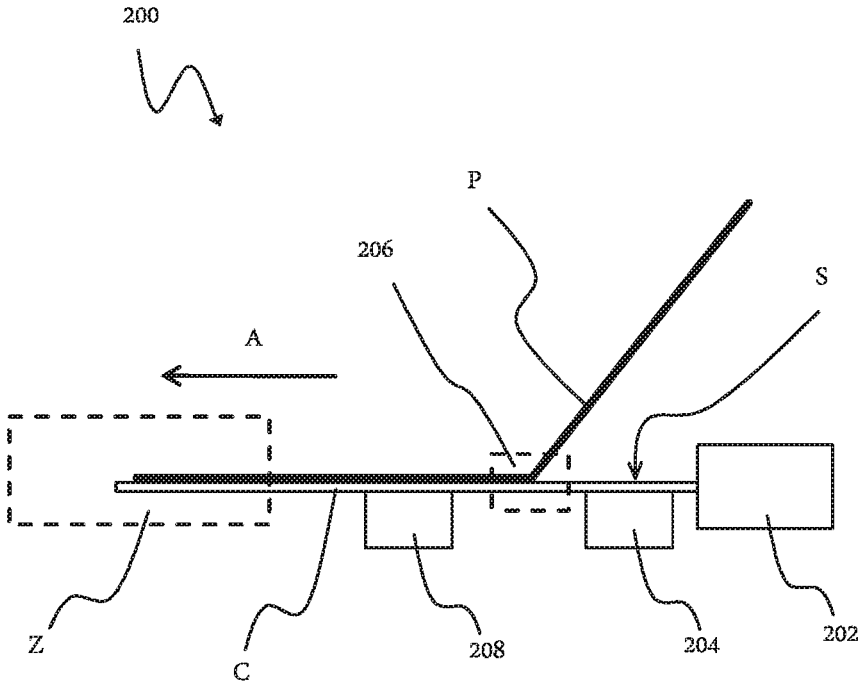
200
P
206
S
A
Z
C
208
204
202

METHOD AND DEVICE FOR REDUCING DISTORTION WHILE PRINTING ON A FLEXIBLE PRINT MEDIUM

BACKGROUND

Some printing devices allow for printing on a flexible print medium. Textile print medium may be an example of a flexible print medium. A flexible print medium may be deformable when applied to a tensile, torsion or shear force. For conveying the flexible print medium through a print zone, mechanical forces may be applied to the flexible print medium.

BRIEF DESCRIPTION OF THE DRAWINGS

FIG. 1 is a flow diagram of a method of conveying a print medium through a print zone of a printing device according to an example.

FIG. 2 is a schematic diagram showing a cross-sectional view of a printing device according to an example.

DESCRIPTION OF THE EXAMPLES

Figure 3A:
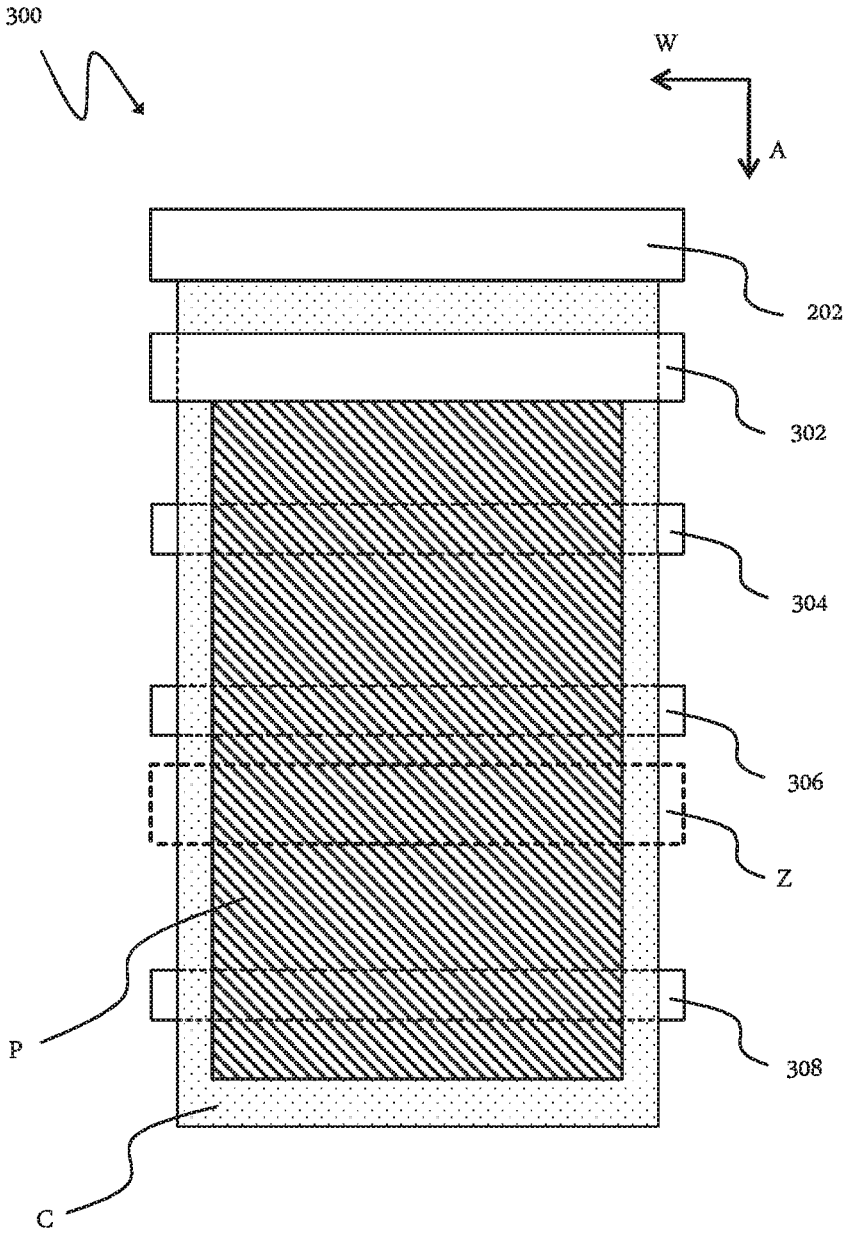
FIG. 3A-3C are schematic diagrams of a printing device according to an example.

In the following, examples of a method and a printing device are described that may allow for reducing or preventing deformation of a flexible print medium when being advanced through a print zone of a printing device. Accordingly, the accuracy of print results on a flexible print medium may be increased. Furthermore, this effect may be achieved in a cost, space and energy saving and environment-friendly manner.

A flexible print medium may be any medium that is stretchable along its width, length, thickness, or any combination thereof. Stretching may include reversible and irreversible deformation until the print medium tears or is otherwise destroyed. For example, the flexible print medium P may include any print medium made of interlacing fibers.

Examples of a flexible print medium include textile, fabric, cloth, woven materials and non-woven materials, such as fleece, artificial leather, synthetic sheets, such as polymer foils, or the like. For example, the flexible print medium may include fibrous material, provided in a planar or sheet-like shape by weaving, knitting, knotting, felting, braiding, spreading, crocheting, bonding, carpeting, or any combination thereof. The flexible print medium may contain a material of animal origin, such as wool, hair, fur, skin, leather or silk, a material of plant origin, such as cotton, flax, hemp or jute, a mineral material, such as asbestos, basalt or glass fiber, or a synthetic material, such as nylon, polyester, acrylic, spandex, aramid, olefin, polylactide, casein or carbon fiber. The flexible print medium may contain any combination of the aforementioned materials. The flexible print medium may further contain geotextile.

The flexible print medium may further include any print medium that has been processed to an end product or an intermediate product, such as garment, decoration, carpet, banner, or the like. Unless otherwise indicated, the print medium P as used herein may refer to any flexible print medium.

FIG. 1 is a flow diagram of a method 100 according to an example. According to the method too, at 102, a carrier is fed from a carrier supply. The carrier has an adhesive surface. At 104, a print medium is engaged with the adhesive surface of the carrier. At 106, the carrier is advanced along with the print medium engaged therewith to a print zone of a printing device.

Referring to FIG. 2, a printing device 200 according to an example comprises a print zone Z, a carrier supply 202, a carrier feed device 204, an engage device 206 and an advance device 208. The printing device 200 is capable of printing on a print medium P, which may include any flexible print medium. The printing device 200 may advance the print medium P and a carrier C through the print zone Z along an advance direction A.

The print zone Z is provided for depositing a print fluid (not shown) on the print medium P. The print zone Z may refer to an area, a zone, a space, or the like, in which the printing device may deposit the print fluid on the print medium P. Alternatively or additionally, the print zone Z may include a structural or functional feature for depositing the print fluid on the print medium P. The printing device 200 may include, for example, a platen to support the print medium P in the print zone Z. The printing device 200 may include, for example, a carriage carrying structural and functional features for depositing the print fluid on the print medium P in the print zone Z. For example, a carriage may carry a printhead, an array of printheads, or nozzles for depositing the print fluid. The carriage may be movably arranged, for example, along a width direction of the print medium P. Alternatively or additionally, an array of nozzles may be arranged over the entire width of the print zone and the print medium P to deposit the print fluid on the print medium P without being moved.

The carrier supply 202 may provide the carrier C to support the print medium. The carrier C may have an adhesive surface S to connect with the print medium P. The carrier supply 202 may contain, store, or accommodate the carrier C. The carrier supply 202 may include the carrier C in a particularly packed form. For example, the carrier supply 202 may include the carrier C provided as an endless roll.

The carrier C may be a planar material suitable for supporting the print medium P. The carrier C may be made of a material having a greater tensile strength and/or less stretchability than the print medium P. The carrier C may be bendable, ductile, or otherwise deformable to a lesser extent when compared to the print medium P under the same conditions.

In some examples, the carrier C may have a tensile strength that is sufficiently high to withstand tensions applied by a conveying mechanism of the printing device 200 (not shown in FIG. 4), without being torn apart, or without being extended irreversibly, or until being deformed by 2%, 5%, 10%, 20%, or 30% of its initial dimension (i.e. compared to a state in which no tensions are applied) in a particular direction. For example, the carrier C may be made of paper or synthetic material, such as carbon fiber, polyester, or the like.

In some examples, the carrier C may contain, or be made of, a continuous carrier web material to counter mechanical forces exerted on the print medium P while being transported through the print zone Z to maintain a shape of the print medium P engaged with the adhesive surface S of the carrier C.

The carrier C may comprise, or be made of, a material having a tensile strength of greater than 50 $N/mm^2$, or greater than 100 $N/mm^2$, or greater than 200 $N/mm^2$. Additionally or alternatively, the carrier C may comprise, or be made of, a material having a tensile strength sufficient to withstand an external tensile force of at least 20 N/m, or at least 30 N/m, or at least 50 N/m, or at least 100 N/m, normalized to the unit width in the width direction W. In this regard, the term withstand may refer to the carrier C being exposed to the respective force without being torn apart, or without being extended irreversibly, or until being deformed by 2%, 5%, 10%, 20%, or 30% of its initial dimension (i.e. compared to a state in which no tensions are applied) in a particular direction. The tensile strength may be determined according to ISO 1924-2.

The tensile strength may relate to a particular stress at which the carrier C begins to deform practically, which may also be referred to as yield strength. If the stress applied is below a yield point indicating the material deforming plastically, the material may deform elastically and return to its original shape when the applied stress is removed. Once the yield point is passed, some fraction of the deformation may be permanent and irreversible.

Alternatively, the tensile strength may refer to a capacity of a material or structure to withstand loads tending to elongate. As such, the tensile strength may refer to a maximum stress that a material can withstand while being stretched or pulled before breaking. The tensile strength as used herein may also be referred to as the ultimate strength, or the ultimate tensile strength.

Alternatively, the tensile strength may refer to a particular stress at which the carrier C elongates to 102%, 105%, 110%, 120%, or 130% of its original length. The stretching may be elastic and reversible, or at least partially plastic and irreversible.

In some examples, the carrier C is supplied in the form of an endless carrier web. Additionally or alternatively, the carrier C is supplied by winding a carrier material on a roll. In further examples, the carrier C is supplied by providing a number of stacked carrier sheets. Accordingly, the carrier supply 202 may be provided as a roll of an endless carrier web, a stack of carrier sheets, or the like.

The carrier feed device 204 may feed the carrier C from the carrier supply 202. The feeding may generally refer to taking the carrier C from the carrier supply 202 for use in the printing device 200. For example, the feeding of the carrier C may include transporting, retrieving, detaching, extracting, drawing, or any combination thereof, the carrier C from the carrier supply 202. The feeding may further include providing the carrier C to be advanced towards the print zone Z.

For example, the carrier supply 202 may be provided as a roll of the carrier C. Accordingly, the feeding of the carrier C may refer to drawing the carrier C from the carrier supply 202, i.e. from the roll, in a continuous manner.

The engage device 206 may engage the print medium P with the adhesive surface S of the carrier C. The printing device 200 may advance the print medium P, the carrier C, or both so as to attach the print medium P to the adhesive surface S of the carrier C. In some examples, the engage device 206 may cause the print medium P, the carrier C, or both, to move towards each other. Then the print medium P may be engaged with the carrier C so as to have surface contact with the carrier C. The engage device 206 may apply a mechanical force or pressure to the print medium P, the carrier C, or both to press the carrier C and the print medium P towards each other so as to cause and support the adhesion of the print medium P to the adhesive surface S of the carrier C. Accordingly, the print medium P may be engaged with the adhesive surface S of the carrier C so as to have surface contact with the adhesive surface S of the carrier C.

In some examples, the adhesive surface S of the carrier C may comprise a pressure-sensitive adhesive. Accordingly, an example of a method may comprise depositing a pressure-sensitive adhesive on one surface of the carrier C, for example by a free-radial polymerization of a viscoelastic polymer, to provide the adhesive surface S. The pressure-sensitive adhesive may form a bond with the print medium P in response to receiving a pressure. For example, the pressure-sensitive adhesive may enter a soft, wet, or flowing state in response to receiving a pressure. A bond between the print medium P and the adhesive surface S may be maintained by bonding forces, such as van-der-Waals force. The pressure-sensitive adhesive may resist flow when stress is applied to the bond. Examples of the pressure-sensitive adhesive include acrylate polymers, and natural or silicone rubbers. For example, the pressure-sensitive adhesive may contain 2-ethylhexyl acrylate, n-butyl-acrylate, methyl acrylate, or t-butyl methacrylate.

Alternatively or additionally, the adhesive surface S of the carrier C may comprise a temperature-sensitive adhesive. Accordingly, an example of a method may comprise depositing or forming a temperature-sensitive adhesive on one surface of the carrier C to provide the adhesive surface S. The temperature-sensitive adhesive may be flowable if heated and harden by cooling. For example, the temperature-sensitive adhesive may contain a polymer hot melt.

Furthermore, the adhesive surface S of the carrier C may contain an adhesive that is applied in a flowing state and harden under specific conditions. For example, the adhesive on the adhesive surface S of the carrier C may harden under evaporation of a solvent, UV radiation, or chemical reaction. For example, the adhesive may contain white glue, resin, epoxy, or the like.

The advance device 208 may advance the carrier C with the engaged print medium P to the print zone Z. With respect to the advance direction A, the advance device 208 may be arranged downstream of the engage device 206. The advance device 208 may comprise a roller (not shown in FIG. 4) to control movement of the carrier C through the print zone Z.

The advance device 208 may comprise further rollers (not shown in FIG. 4) to further support the control of the movement of the carrier C towards and from the print zone Z.

With the print medium P being attached to, or engaged with, the adhesive surface S of the carrier C, the print medium P may be carried by the carrier C through the print zone Z. Accordingly, in an example of a method, advancing the carrier C may include assisting transport of the print medium P through the print zone Z.

In some examples, the carrier C has material properties such as to counter mechanical forces exerted on the print medium P engaged with the adhesive surface of the carrier while being transported through the print zone Z. Thus, the carrier C may contribute to preventing deformation of the print medium P when entering the print zone Z. Accordingly, a shape of the print medium P may be maintained during a printing process, and the accuracy of print results on the print medium P may be increased.

In examples where at least one roller is used to apply a tensioning force to the carrier C to transport the carrier C through the print zone Z, the carrier C may have a tensile strength to sustain the applied tensioning force with a relative deformation of 0.1 to 2%. The relative deformation may refer to a deformation, elastically or plastically, compared to original dimensions in any directions.

According to the examples of a method and printing device as described herein, deformation of a flexible print medium may be reduced or prevented when being advanced through a print zone. Accordingly, the accuracy of print results on a flexible print medium may be increased.

Figure 3B:
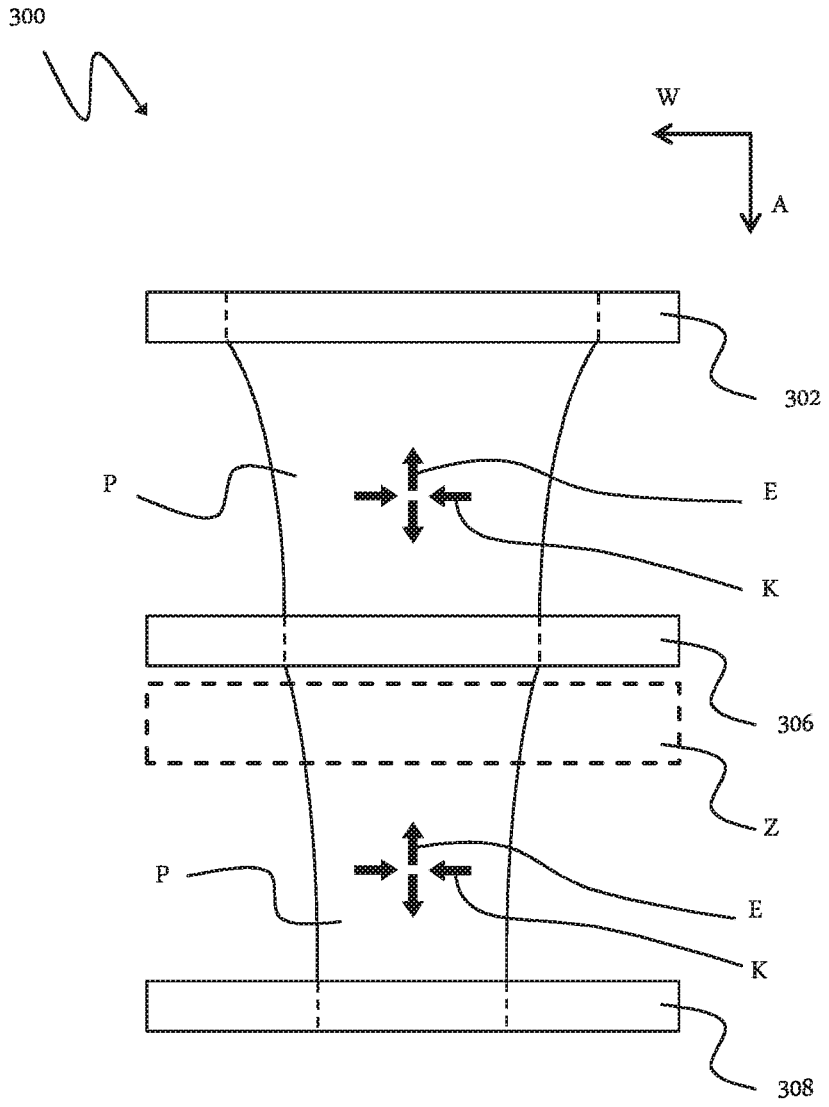
Figure 3C:
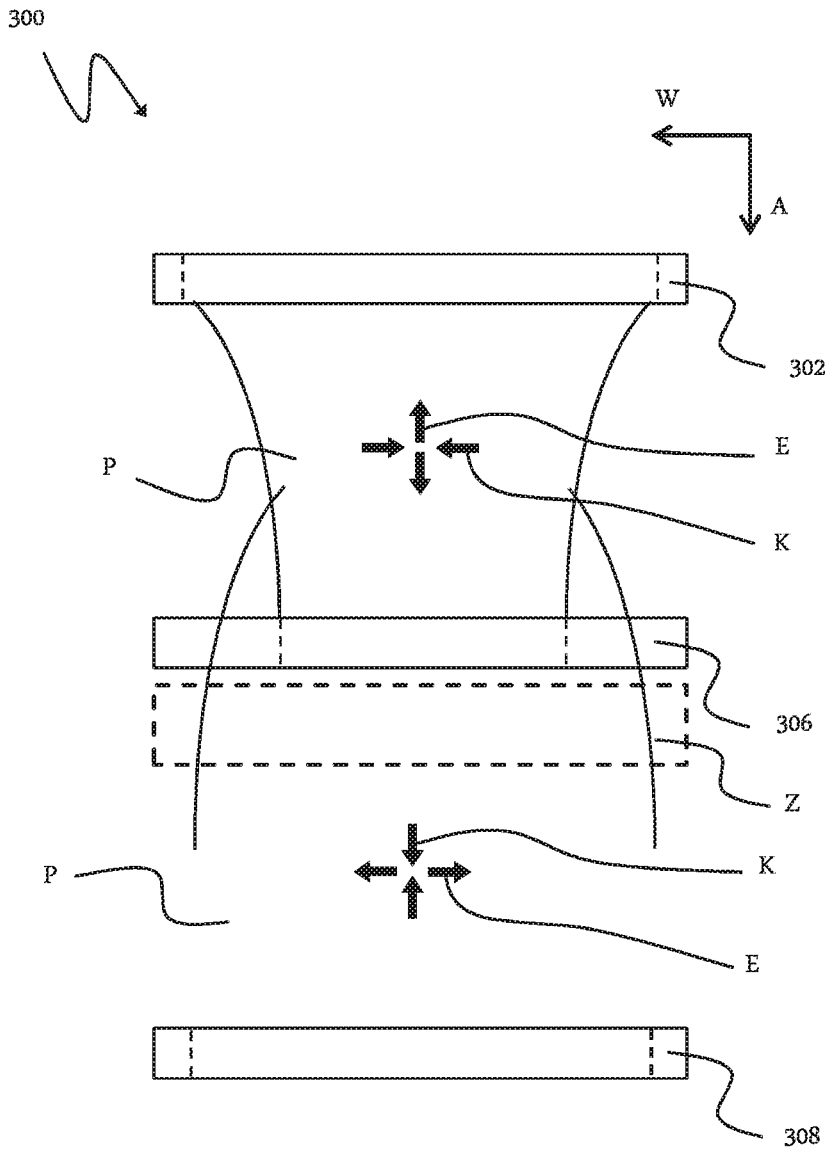

FIG. 3A to 3C illustrate a printing device 300 according to another example. In FIG. 3A to 3C, same reference signs are used as in the previous drawing FIG. 2 to indicate similar or identical structural and functional features, unless otherwise indicated. Reference is made to the above description of FIG. 2. The printing device 300 may comprise the functional and structural features of the printing device 200 as described above with reference to FIG. 2.

The printing device 300 comprises a print medium supply 302 to provide the print medium P for use with the printing device 300. For example, the print medium supply 302 may receive, store, or retrieve the print medium P or any combination thereof. In some examples, the print medium supply 302 may include the print medium P wound on a roll to be provided in a continuous manner. The print medium supply 302 may be arranged, with respect to the carrier supply 202, at a position facing the adhesive surface S (not shown in FIG. 3A) of the carrier C so as to facilitate the engaging of the print medium P with the adhesive surface S of the carrier C. In an example, the print medium supply 302 may comprise a roller to exert a tension force on the print medium P.

The printing device 300 may further comprise an input roller 304, a drive roller 306, and an output roller 308. In some examples, the drive roller 306 may be arranged between the input roller 304 and the output roller 308. Any of the input roller 304, the drive roller 306, and the output roller 308 may be arranged so as to be in surface contact with, in linear contact with, or partially wound by, the carrier C and to advance the carrier C in the advance direction A by means of friction at the contact surface. For this purpose, the input roller 304, the driver roller 306, and the output roller 308 may be, for example, arranged at different distances from a plane spanned by the advance direction A and the width direction W which are indicated in FIG. 3A. Thus, the printing device 300 may comprise an advance device, although not explicitly shown, comprising at least one of, or all of, the input roller 304, drive roller 306, and output roller 308.

Each of the input roller 304, the drive roller 306, and the output roller 308 may apply a respective tension force to advance the carrier C, and thus also the print medium P, towards, through and from the print zone Z. The tension forces may be exerted in the advance direction A. Any of the rollers 304 to 308 may exert a respective tension force of up to 10 N/m, or up to 30 N/m, or up to 50 N/m, or up to 100 N/m, normalized to the unit width of the carrier C or the print medium P. The carrier C as used herein may have a tensile strength that is sufficient to withstand, counter or absorb the tensile forces applied to advance the print medium P through the print zone Z. For example, the carrier C may have a tensile strength such as to reduce the tensile forces applied to the print medium by at least 20%, by at least 50%, or by at least 80%. Accordingly, the carrier C may be made of a material as described above. Additionally or alternatively, the carrier C may be processed such as to have the corresponding material properties as described above.

Although not shown in FIG. 3A, the printing device 300 may further comprise an engage device to engage the print medium P with an adhesive surface of the carrier C. The carrier C is advanced through the print zone Z using any or all of the input roller 304, drive roller 306 and output roller 308. For example, the input roller 304 may be a free roller which is not actively driven. Furthermore, the carrier supply 202 may apply a tensioning force to the carrier C. With the print medium P being engaged with the adhesive surface of the carrier C and thereby attached to the carrier C, the print medium P, too, may be advanced through the print zone Z synchronously with the carrier movement. The carrier C may withstand, counter, or absorb the tensile forces exerted by the rollers 304 to 308. Thus, the carrier C may prevent, or at least reduce, a deformation of the print medium P when advancing through the print zone Z, thereby increasing the accuracy of print results on the print medium P.

FIGS. 3B and 3C illustrate comparative situations that may occur if the printing device 300 was operated without using the carrier C. FIG. 3B illustrates a situation in which the tension force exerted by the output roller 308 is greater than the tension force exerted by the drive roller 306. In such a case, the print medium P may elongate towards the output roller 308, as indicated by arrows E, and at the same time contract along a width direction W, as indicated by arrows K. Accordingly, lateral edges of the print medium P may become curved inwards. Similar curvatures may occur between the drive roller 18 and the input roller 14.

FIG. 3C illustrates a state in which the tension force exerted by the drive roller 306 is greater than the tension force exerted by the output roller 308. In such a case, the print medium P may contract along a width direction W at the drive roller 306, as indicated by arrows K. At the same time, the width of the print medium P at the input roller 304 and at the output roller 308 may remain identical or similar. Accordingly, lateral edges of the print medium P may become curved outwards. This may cause the print medium P to form wrinkles, curvatures or bubbles in an area immediately downstream of the drive roller 306.

In the situations illustrated in FIGS. 3B and 3C, the print medium P may be deformed within the print zone Z, thereby impairing the accuracy of printing results. Hence, the use of the carrier C as disclosed herein may allow for reducing or preventing deformation of a flexible print medium when being advanced through a print zone. Furthermore, this effect may be achieved in a cost, space and energy saving and environment-friendly manner.

Figure 4:
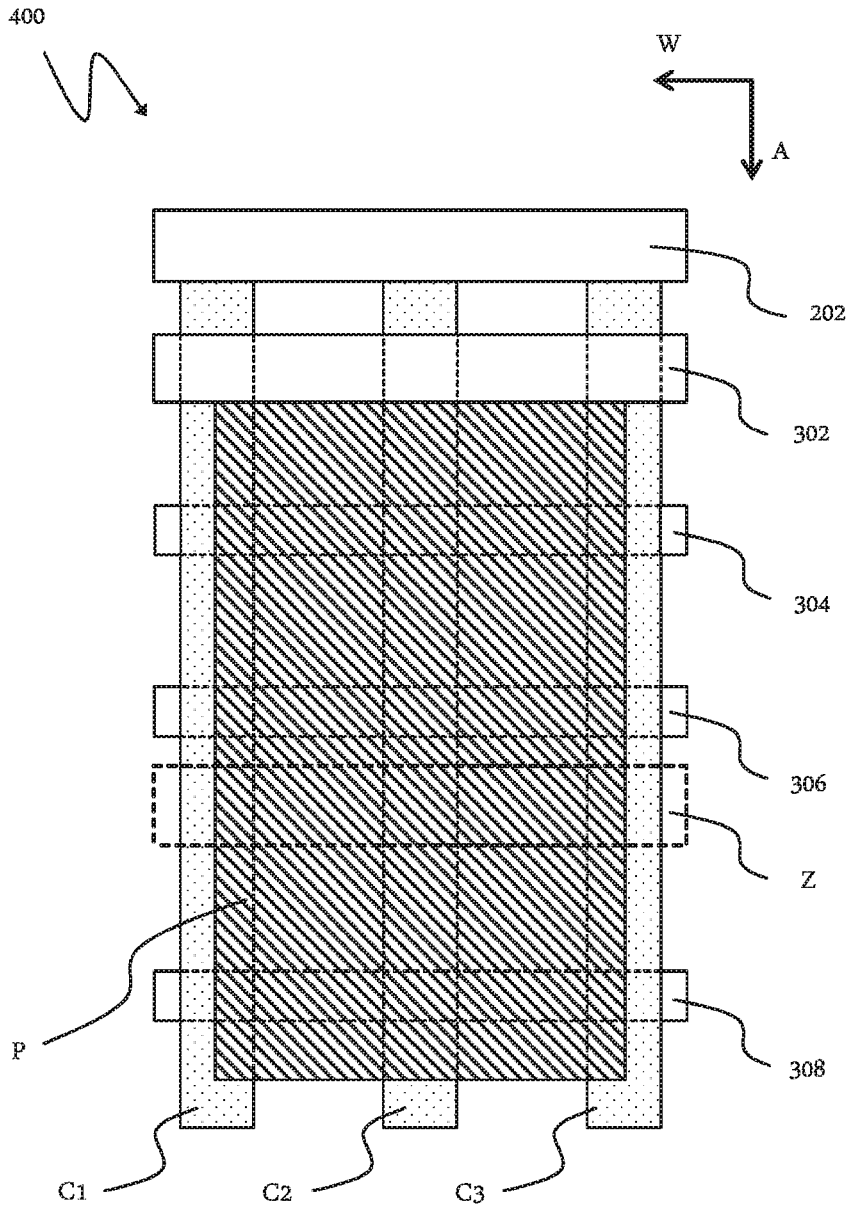
FIG. 4 is a schematic diagram of a printing device according to an example.

FIG. 4 illustrates a printing device 400 according to a further example. In FIG. 4, same reference signs are used as in the previous drawings FIGS. 2 and 3A to 3C to indicate similar or identical structural and functional features, unless otherwise indicated. Reference is made to the above description of FIGS. 2 and 3A to 3C.

Whereas the printing device 300 as shown in FIG. 3A may use the carrier C being provided as a continuous web of carrier material, the printing device 400 may use the carrier C being provided as multiple parallel continuous carrier webs C1, C2 and C3. Each of the carrier webs C1 to C3 may be made of a material as described above with respect to the carrier C. In some examples, the carrier webs C1 to C3 may have an equal dimension in the width direction W. In other examples, the carrier webs C1 to C3 may have different dimensions in the width direction W (not shown). Although three carrier webs C1 to C3 are shown in FIG. 4, the number of the carrier webs may vary. For example, other examples of a printing device may use two, four or more carrier webs of same, partially of the same or all different dimensions in the width direction W.

Any of the carrier webs C1 to C3 may comprise a respective adhesive surface (not explicitly shown in FIG. 4) as described above with respect to the adhesive surface S. Accordingly, the print medium P may be engaged with any or all of the carrier webs C1 to C3. With the carrier webs C1 to C3 being advanced through the print zone Z, the print medium P being attached to the carrier webs C1 to C3 may be advanced through the print zone Z as well. The carrier webs C1 to C3 may prevent, or at least reduce, a deformation of the print medium P when advancing through the print zone Z, thereby increasing the accuracy of print results on the print medium P.

Figure 5:
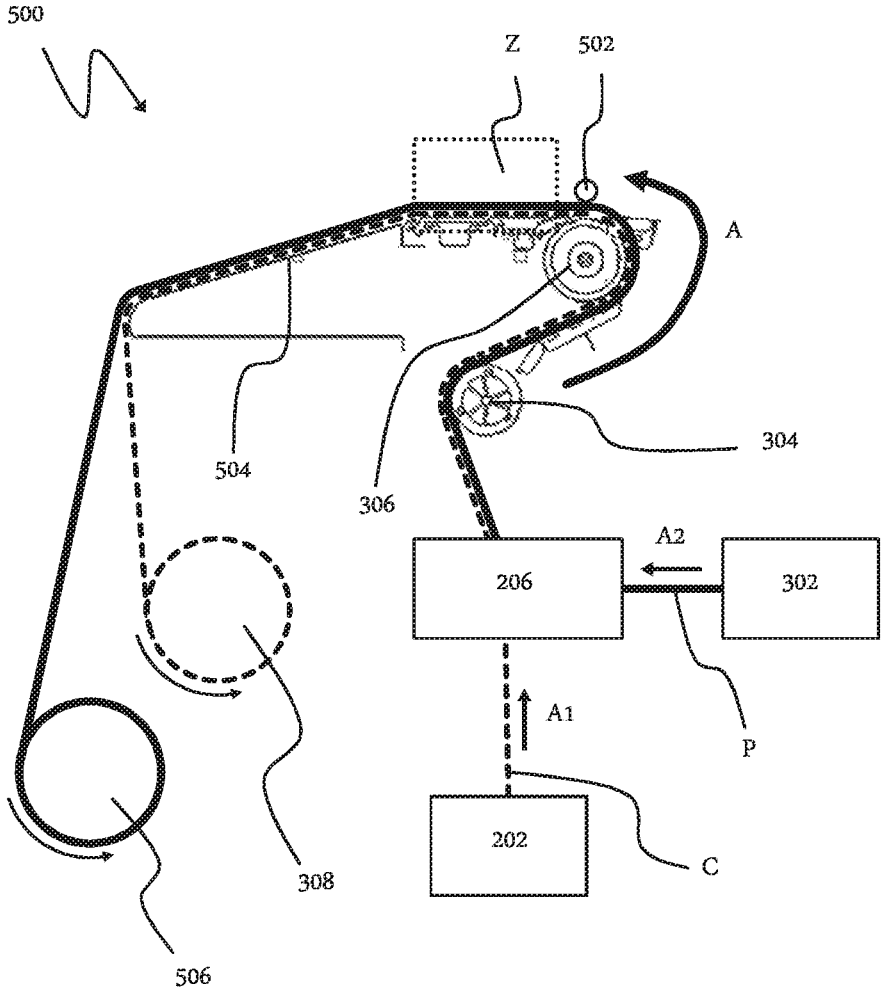
FIG. 5 is a schematic diagram showing a cross-sectional view of a printing device according to an example.

FIG. 5 illustrates a printing device 500 according to a further example. In FIG. 5, same reference signs are used as in the previous drawings FIG. 2 to 4 to indicate similar or identical structural and functional features, unless otherwise indicated. Reference is made to the above description of FIG. 2 to 4.

The printing device 500 may comprise the carrier supply 202 to supply the carrier C, the print medium supply 302 to supply the print medium P, and the engage device 206 to engage the print medium P with the adhesive surface S (not explicitly shown in FIG. 5) of the carrier C. In FIG. 4, the supply directions of the carrier C and the print medium P are indicated by arrows A1 and A2, respectively. Further, the printing device 500 may comprise the input roller 304, the driver roller 306 and the output roller 308 to advance the carrier C through the print zone Z.

The printing device 500 may further comprise a pinch unit 502 arranged upstream of the print zone Z in terms of the advance direction A. The pinch unit 502 may operate to press the print medium P against the carrier C prior to entering the print zone Z. Accordingly, possible surface irregularities, such as wrinkles, curvatures or bubbles, may be eliminated. Moreover, the pint unit 502 may apply a normal force to print medium P and/or to the carrier C. This may assist the drive roller 306 to advance the print medium P and/or the carrier C. The normal force applied by the pinch unit 502 may be in a direction that is perpendicular to a surface of the print medium P and/or the carrier C. The normal force may also be referred to as a pinch force.

The printing device 500 may further comprise a ramp 504 arranged downstream of the print zone 504 with respect to the advance direction A. Accordingly, the carrier C may glide on the ramp 504 after leaving the print zone Z. The ramp 504 may redirect a tensile stress exerted by the output roller 308 into a direction that does not differ too much from the advance direction A. This may facilitate to hold flat the print medium P in the print zone Z.

The printing device 500 may further comprise a secondary output roller 506 for retrieving the print medium P after having passed the print zone Z. For example, the secondary output roller 506 may roll up the print medium P separately from the carrier C, which is rolled up by the output roller 308. The print medium P may be separated from the carrier C by means of an additional separation mechanism (not shown) or by being rolled in separately by the secondary output roller 506.

Figure 6:
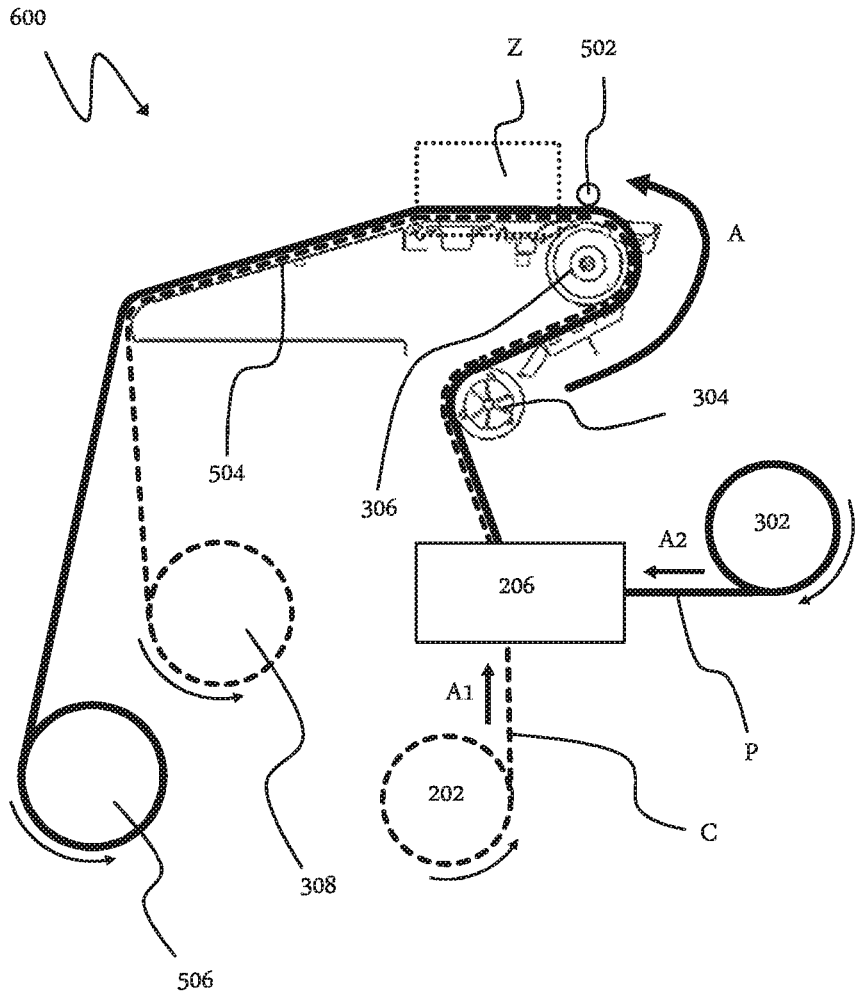
FIG. 6 is a schematic diagram showing a cross-sectional view of a printing device according to an example.
Figure 8:
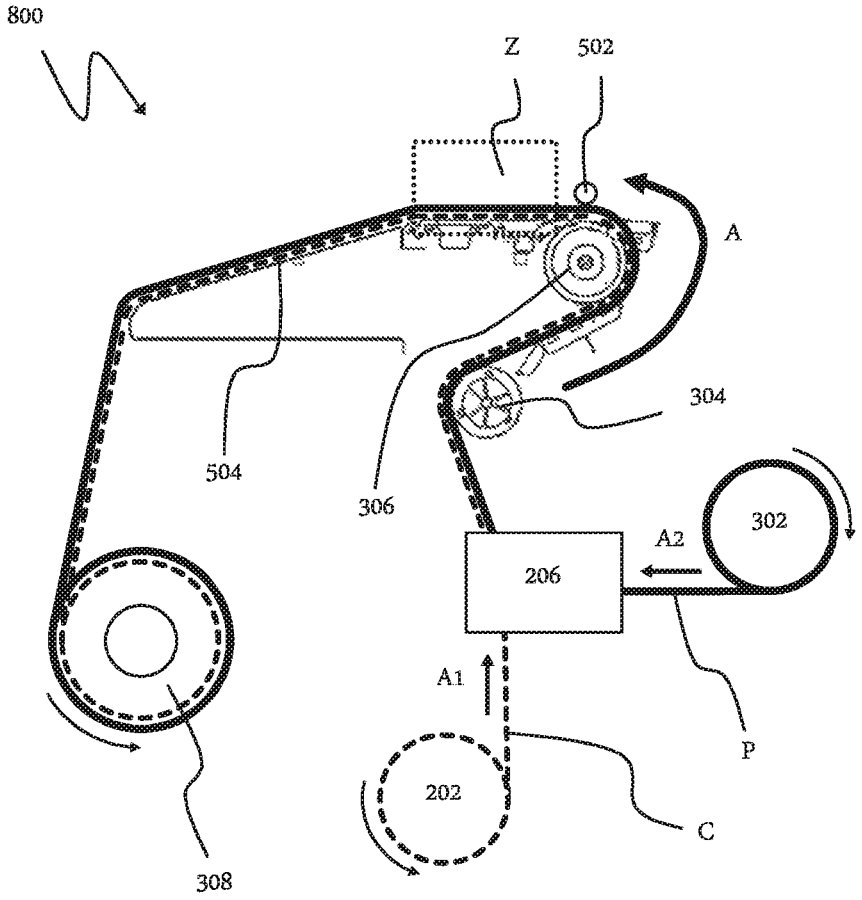
FIG. 8 is a schematic diagram showing a cross-sectional view of a printing device according to an example.

FIG. 6 illustrates a printing device 600 according to a further example. In FIG. 8, same reference signs are used as in the previous drawings FIG. 2 to 5 to indicate similar or identical structural and functional features, unless otherwise indicated. Reference is made to the above description of FIG. 2 to 5.

In the printing device 600, the carrier supply 202 may be provided as a roll on which the carrier C is wound. Accordingly, the carrier supply 202 may then be unrolled to provide the carrier C along the carrier advance direction A1. In addition, the print medium supply 302 may be provided as a roll on which the print medium P is wound as shown in FIG. 6.

Figure 7:
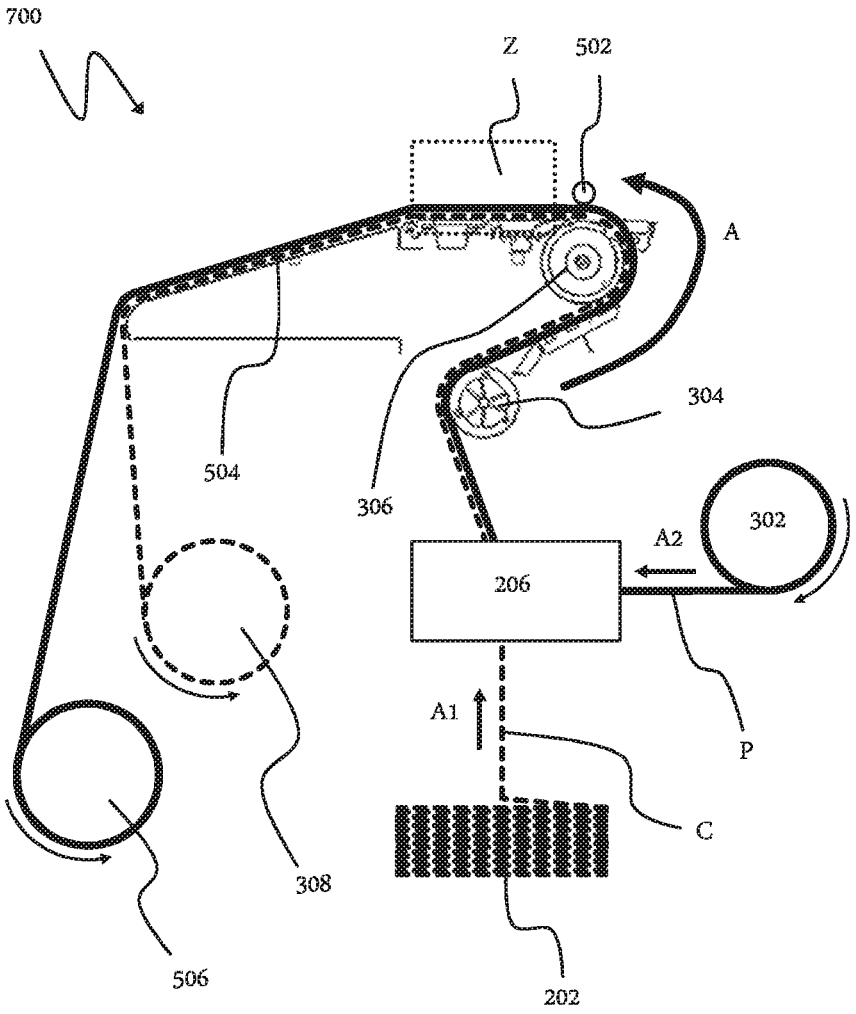
FIG. 7 is a schematic diagram showing a cross-sectional view of a printing device according to an example.

FIG. 7 illustrates a printing device 700 according to a further example. In FIG. 7, same reference signs are used as in the previous drawings FIG. 2 to 6 to indicate similar or identical structural and functional features, unless otherwise indicated. Reference is made to the above description of FIG. 2 to 6.

In the printing device 700, the carrier supply 202 is provided as a container or storage of an endless carrier web or a number of stacked carrier sheets. The carrier C may be provided such that the carrier C may be fed in a continuous manner.

FIG. 8 illustrates a printing device 800 according to a further example. In FIG. 10, same reference signs are used as in the previous drawings FIG. 4-9 to indicate similar or identical structural and functional features, unless otherwise indicated. Reference is made to the above description of FIG. 2 to 7.

The printing device 800 comprises one single output roller 308. The output roller 308 may be operated to roll up the carrier C with the print medium P being engaged to its adhesive surface S. Accordingly, the print medium P may be retrieved together with the carrier C after the print medium has passed the print zone Z.

Figure 9:
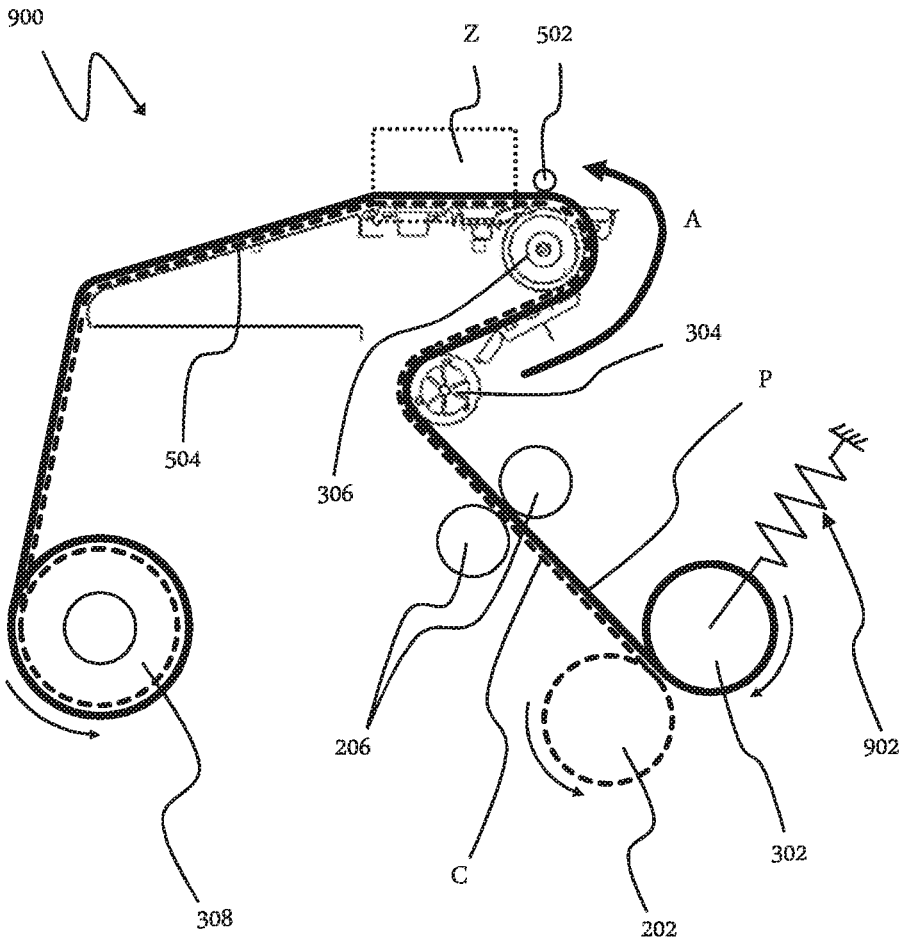
FIG. 9 is a schematic diagram showing a cross-sectional view of a printing device according to an example.
Figure 10:
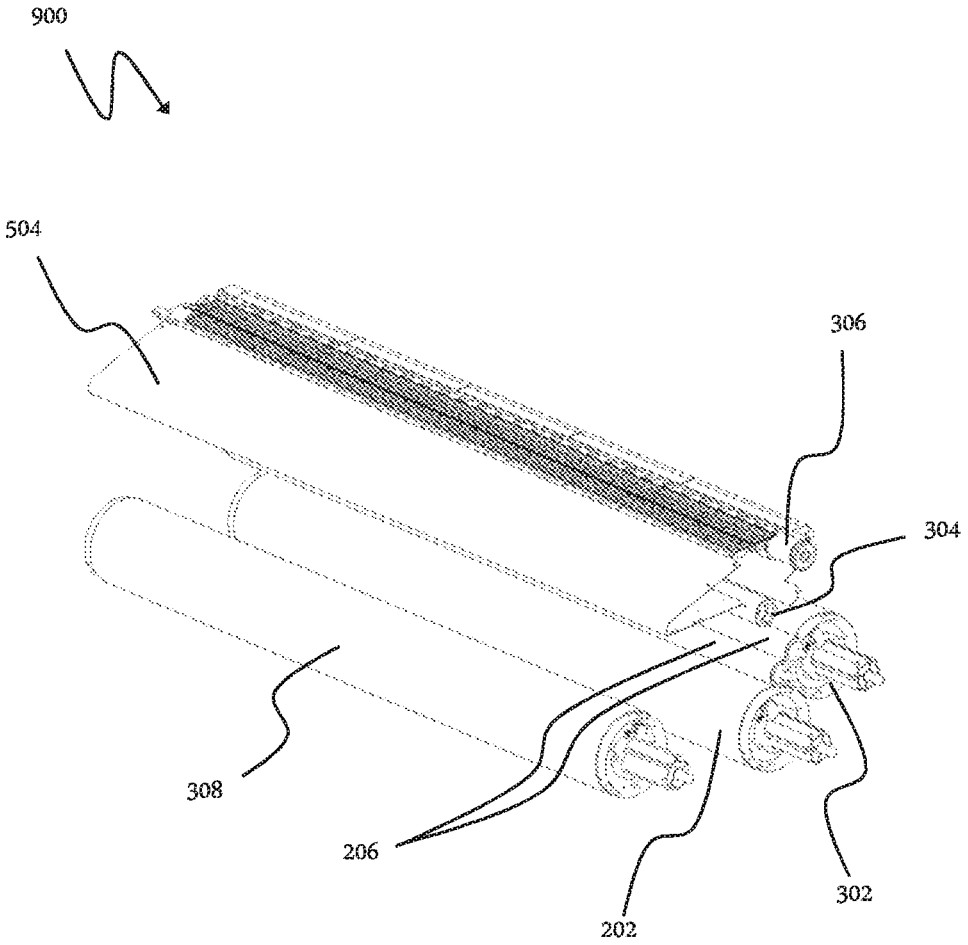
FIG. 10 is a schematic diagram showing a perspective view of a printing device according to an example.

FIGS. 9 and 10 illustrate a printing device 900 according to a further example. In FIG. 9 and to, same reference signs are used as in the previous drawings FIG. 4-10 to indicate similar or identical structural and functional features, unless otherwise indicated. Reference is made to the above description of FIG. 2 to 8.

In the printing device 900, the carrier supply 202 may be provided as a roll on which the carrier C is wound, and the print medium supply 302 may be provided as a roll on which the print medium P is wound. The carrier supply 202 and the print medium supply 302 may be arranged relative to each other such that the positions at which the carrier C and the print medium P are released by unrolling the carrier C from the carrier supply 202 and the print medium P from the print medium supply 302, respectively, may coincide. This may reduce the size of the printing device 900.

In addition, a first one of the carrier supply 202 and the print medium supply 302 may be arranged in a locally fixed manner, and the other one may be pressed against the first one. In the example shown in FIG. 9, the carrier supply 202 may be locally fixed, while the print medium supply 302 is pressed against the carrier supply 202 by means of a spring force exerted by a spring unit 902. In another example (not shown), the print medium supply 302 may be locally fixed, and the carrier supply 202 may be pressed against the print medium supply 302.

The spring unit 902 as described herein is an example. Any other mechanism may be used to exert a pressing force on the carrier supply 202, the print medium supply 302, or both. For example, the carrier supply 202, the print medium supply 302, or both may be pressed against each other by means of hydraulic force, a gas pressure, electrically, magnetically, or any combination thereof.

Furthermore in the printing device 900, the engage device 206 may comprise a pair of rollers that press the print medium P against the carrier C, or vice versa. Accordingly, one of the rollers 206 may be arranged in a locally fixed manner, and the other roller may be movable to be pressed against the one roller.

The invention claimed is:

1. A method, comprising feeding a carrier from a carrier supply, the carrier having an adhesive surface; engaging a print medium with the adhesive surface, of the carrier; advancing the carrier with the engaged print medium to a print zone of a printing device; and transporting the carrier through the print zone by means of at least one roller applying a tensioning force to the carrier, wherein the carrier has a tensile strength to sustain the applied tensioning force with a relative deformation of 0.1 to 2%.

2. The method of claim 1, further comprising providing the carrier supply by at least one of: providing an endless carrier web; winding a carrier material on a roll; and providing a number of stacked carrier sheets.

3. The method of claim 2, wherein the carrier counters mechanical forces exerted on the print medium while being transported through the print zone to maintain a shape of the print medium engaged with the adhesive surface of the carrier.

4. The method of claim 1, wherein advancing the carrier includes assisting transport of the print medium through the print zone.

5. The method of claim 1, wherein the carrier is provided as a continuous web of carrier material or as multiple parallel continuous webs.

6. The method of claim 1, wherein the print medium is engaged with the carrier so as to have a surface contact with the carrier.

7. The method of claim 1, wherein the adhesive surface comprises adhesive deposited on one surface of the carrier, wherein the adhesive is at least one of a pressure-sensitive adhesive and a temperature-sensitive adhesive.

8. The method of claim 1, further comprising pressing the print medium against the carrier prior to entering the print zone.

9. The method of claim 1, further comprising retrieving the print medium together with the carrier after the print medium has passed the print zone.

10. A continuous carrier web for use as carrier material for a printing device, the continuous carrier web having an adhesive surface to engage with a print medium, wherein the continuous carrier web is to counter mechanical forces exerted on the print medium while being transported through a print zone to maintain a shape of the print medium engaged with the adhesive surface of the carrier material, and wherein the carrier material has a tensile strength to sustain an applied tensioning force applied to the carrier material with a relative deformation of 0.1 to 2%.

11. The carrier material of claim 10 having a tensile strength of greater than 100 N/m·sup·2.

12. A printing device, comprising a print zone to deposit a print fluid on a print medium; a carrier supply to provide a carrier having an adhesive surface to carry the print medium; a carrier feed device to feed the carrier from the carrier supply; an engage device to engage the print medium with the adhesive surface of the carrier; and an advance device to advance the carrier with the engaged print medium to a print zone, wherein the carrier is to sustain tensions applied by the at least one roller with a relative deformation of 0.1 to 2%.

13. The print device of claim 12, wherein the carrier supply comprises at least one of: an endless carrier web; a carrier material wound on a roll; and a number of stacked carrier sheets.

14. The print device of claim 12, wherein the advance device comprises at least one roller to control movement of the carrier through the print zone.

* * * * *